US005566898A

United States Patent [19]

Cline

[11] Patent Number: 5,566,898

[45] Date of Patent: Oct. 22, 1996

[54] HOSE STORAGE SYSTEM

[76] Inventor: Michael W. Cline, 678 Salem Quinton Rd., Salem, N.J. 08079

[21] Appl. No.: 440,670

[22] Filed: May 15, 1995

[51] Int. Cl.[6] ..... B65M 75/34

[52] U.S. Cl. ..... 242/379; 242/398

[58] Field of Search ..... 242/379.2, 381, 242/385.1, 385.3, 397, 398, 404, 406; 220/264, 326, 375

[56] References Cited

U.S. PATENT DOCUMENTS

| | | | |
|---|---|---|---|
| 1,049,136 | 12/1912 | Noble | 242/398 |
| 1,242,015 | 10/1917 | Meas | 242/398 |
| 2,517,118 | 8/1950 | Lee | 242/398 |
| 2,576,526 | 11/1951 | Marchand | 220/335 |
| 2,912,525 | 11/1959 | Ures | 242/379.2 |
| 3,021,089 | 2/1962 | Becker | 242/381 |
| 4,062,493 | 12/1977 | Suggs | 242/398 |
| 4,177,963 | 12/1979 | Takahashi et al. | 242/379.2 |
| 4,586,676 | 5/1986 | Johnston et al. | 242/404 |
| 4,655,365 | 4/1987 | Miller | 220/335 |
| 4,813,627 | 3/1989 | Nelson | 242/385.3 |

FOREIGN PATENT DOCUMENTS

| | | | |
|---|---|---|---|
| 115817 | 9/1942 | Australia | 220/326 |
| 3345772 | 7/1984 | Germany | 242/398 |
| 63-202569 | 8/1988 | Japan | 242/397 |
| 797592 | 7/1958 | United Kingdom | 242/406 |
| WO89/03360 | 4/1989 | WIPO | 242/385.1 |

*Primary Examiner*—John P. Darling

[57] ABSTRACT

A hose storage system comprising a cylindrical core with opposed ends and a central hose supporting extent therebetween; a bracket having a centrally disposed horizontal central component and vertically disposed end components with apertures rotatably receiving the ends of the core; a drive controller coupled to one end component of the bracket; and a box having an open interior end and an open exterior end and a passage therethrough for the passage of portions of a hose supported on the core, the box having a long interior extent and a short exterior extent.

3 Claims, 3 Drawing Sheets

HOSE STORAGE SYSTEM

BACKGROUND OF THE INVENTION

1. Field of the Invention

The present invention relates to a hose storage system and, more particularly, pertains to supporting a hose in a closed system to facilitate its storage and usage.

2. Description of the Prior Art

The use of devices to support hoses and like flexible objects is known in the prior art. More specifically, devices to support hoses and like flexible objects heretofore devised and utilized for the purpose of supporting and maintaining hoses and similar long flexible items through a wide variety of methods and apparatuses are known to consist basically of familiar, expected, and obvious structural configurations, notwithstanding the myriad of designs encompassed by the crowded prior art which has been developed for the fulfillment of countless objectives and requirements.

In this respect, the hose storage system according to the present invention substantially departs from the conventional concepts and designs of the prior art, and in so doing provides an apparatus primarily developed for the purpose of supporting a hose in a closed system to facilitate its storage and usage.

Therefore, it can be appreciated that there exists a continuing need for a new and improved hose storage system which can be used for supporting a hose in a closed system to facilitate its storage and usage. In this regard, the present invention substantially fulfills this need.

SUMMARY OF THE INVENTION

In view of the foregoing disadvantages inherent in the known types of devices to support hoses and like flexible objects now present in the prior art, the present invention provides an improved hose storage system. As such, the general purpose of the present invention, which will be described subsequently in greater detail, is to provide a new and improved hose storage system and method which has all the advantages of the prior art and none of the disadvantages.

To attain this, the present invention essentially comprises a new and improved hose storage system for supporting a hose in a closed system to facilitate its storage and usage comprising, in combination, a cylindrical core positionable in a horizontal orientation with opposed ends and a central hose supporting extent therebetween; a bracket having a centrally disposed horizontal central component positioned beneath the joist of a building and vertically disposed end components extending downwardly therefrom with apertures rotatably receiving the ends of the core; a drive controller coupled to one end component of the bracket for allowing the rotation of the core in a first direction to effect unwinding of a hose therefrom and for allowing the rotation of the core in a second direction to effect the rewinding of a hose onto the core; a box positionable in a vertical wall of a building adjacent to the bracket, the box having an open interior end and an open exterior end and a passage therethrough for the passage of portions of a hose supported on the core, the box having a long interior extent and a short exterior extent; a plurality of pairs of short rollers rotatably mounted in the interior extent of the box about both horizontal and vertical axes and two pair of long rollers rotatably mounted in the exterior extent of the box about horizontal and vertical axes, the long rollers being wider spaced from each other than the short rollers to allow receipt therebetween of a hose end and a nozzle in the exterior extent of the box; a door pivotally mounted to the box and movable between a raised open orientation allowing access to a hose and nozzle therein and a closed orientation; a spring-urged ball in the door located adjacent to the box with an associated detente in the box to hold the door in a raised orientation; a gasket located within the periphery of the door to effect the sealing closure of the box; and a spring-urged lock formed in the door adapted to be coupled with respect to an adjacent portion of the box when the door is closed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose storage system which has all the advantages of the prior art devices to support hoses and like flexible objects and none of the disadvantages.

It is another object of the present invention to provide a new and improved hose storage system which may be easily and efficiently manufactured and marketed.

It is a further object of the present invention to provide a new and improved hose storage system which is of a durable and reliable construction.

An even further object of the present invention is to provide a new and improved hose storage system which is susceptible of a low cost of manufacture with regard to both materials and labor, and which accordingly is then susceptible of low prices of sale to the consuming public, thereby making such devices to support hoses and like flexible objects economically available to the buying public.

Still yet another object of the present invention is to provide a new and improved hose storage system which provides in the apparatuses and methods of the prior art some of the advantages thereof, while simultaneously overcoming some of the disadvantages normally associated therewith.

Even still another object of the present invention is to support a hose in a closed system to facilitate its storage and usage.

Lastly, it is an object of the present invention to provide a hose storage system comprising a cylindrical core with opposed ends and a central hose supporting extent therebetween; a bracket having a centrally disposed horizontal central component and vertically disposed end components with apertures rotatably receiving the ends of the core; a drive controller coupled to one end component of the bracket; and a box having an open interior end and an open exterior end and a passage therethrough for the passage of portions of a hose supported on the core, the box having a long interior extent and a short exterior extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
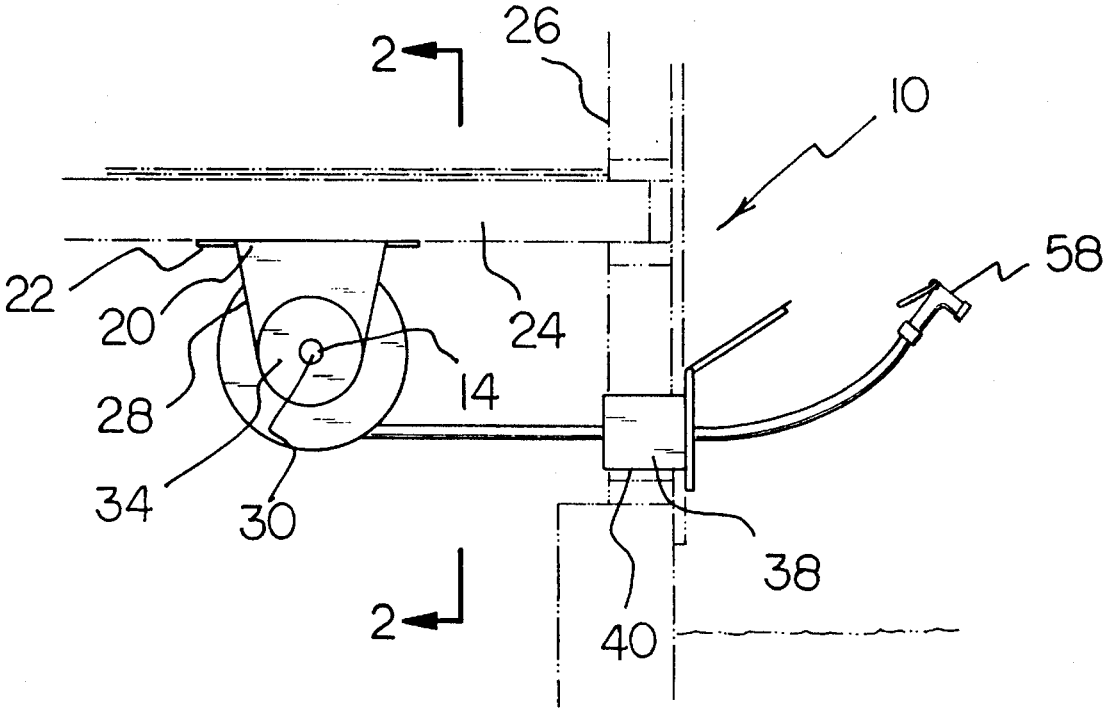
FIG. 1 is a side elevational view of the new and improved hose storage system shown in an operative orientation with respect to a building constructed in accordance with the principles of the present invention.
Figure 2:
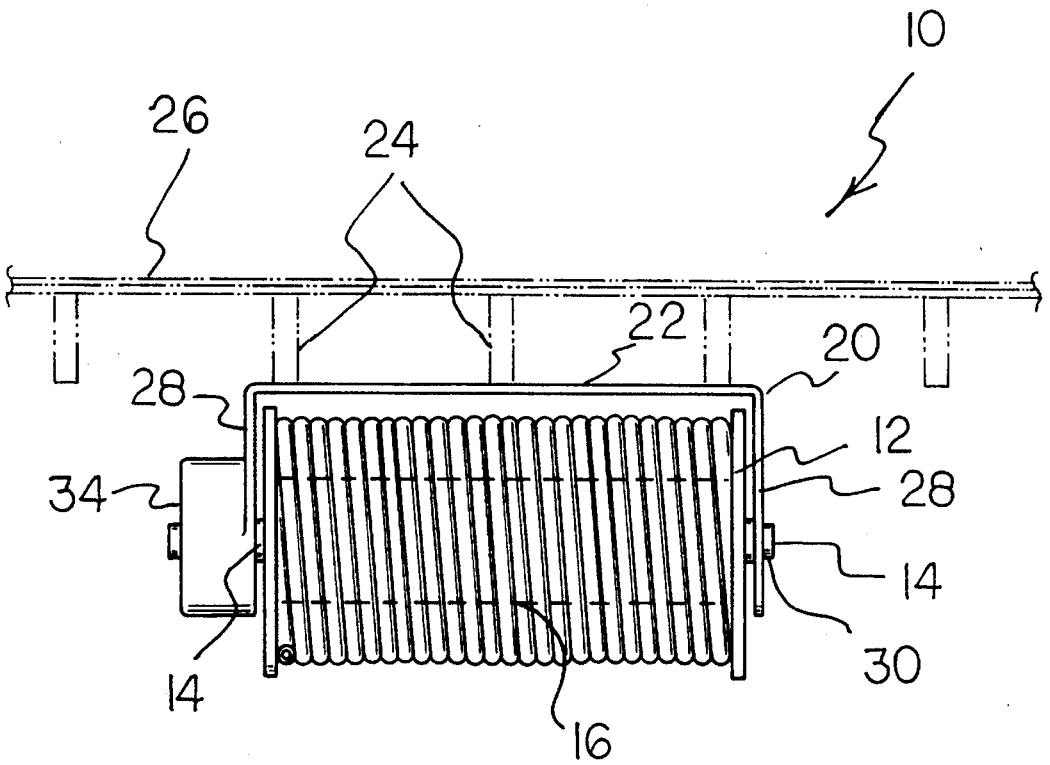
FIG. 2 is a front elevational view of the hose support shown in FIG. 1 taken along line 2—2 thereof.
Figure 3:
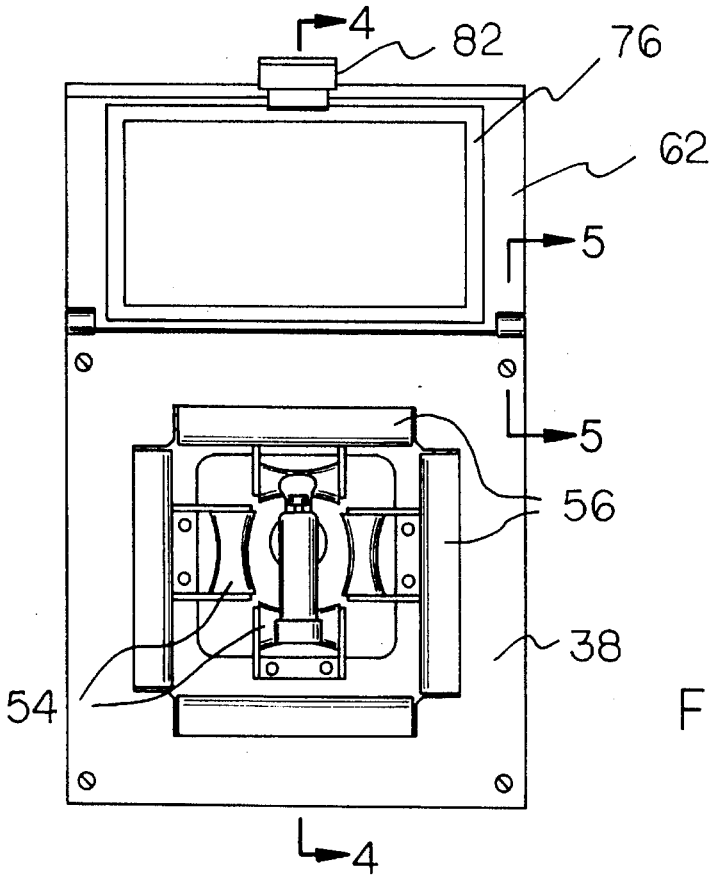
FIG. 3 is a front elevational view of the system shown in FIG. 1 with the hose end nozzle in the fully stored orientation.
Figure 4:
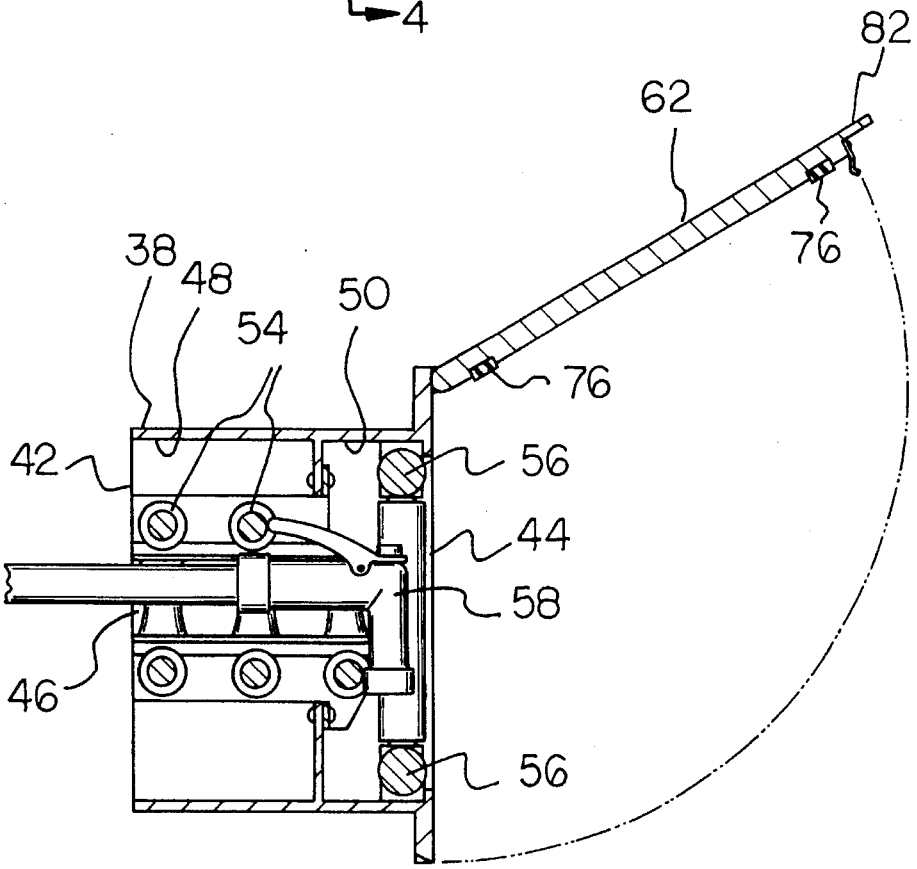
FIG. 4 is a cross-sectional view of the device of the prior Figures taken along line 4—4 of FIG. 3.
Figure 5:
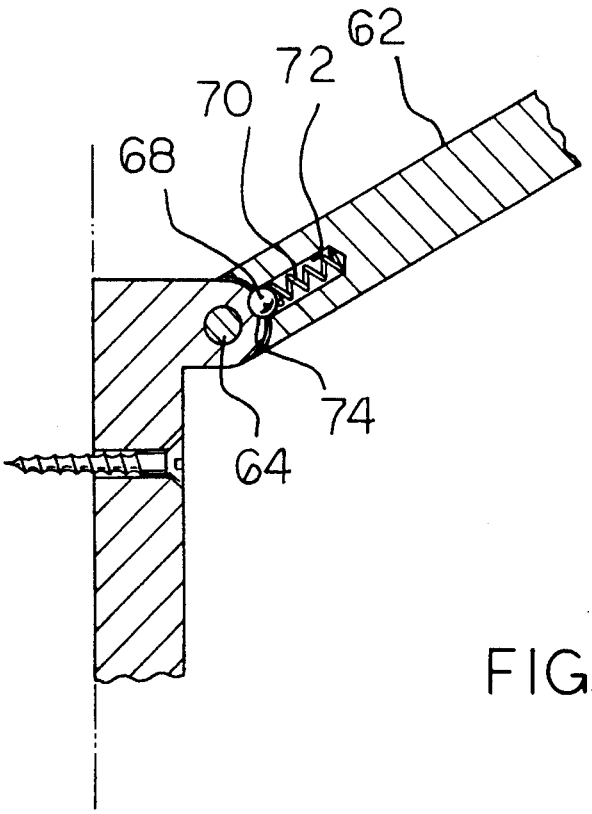
FIG. 5 is a cross-sectional view of a hinge shown in FIG. 3 taken along line 5—5 thereof.

With reference now to the drawings, and in particular to FIG. 1 thereof, the preferred embodiment of the new and improved hose storage system embodying the principles and concepts of the present invention and generally designated by the reference numeral 10 will be described.

The present invention, the new and improved hose storage system, is a system 10 comprised of a plurality of components. In their broadest context, such components include a cylindrical core, a bracket, a drive controller, a box, rollers, a door, a spring, a gasket and a lock. Each of the individual components is specifically configured and correlated one with respect to the other so as to attain the desired objectives.

More specifically, the central component of the system 10 of the present invention is a cylindrical core 12. Such cylindrical core is preferably positioned in a horizontal orientation. It has opposed ends 14 and a central hose supporting extent 16 between the ends.

In association with the core is a bracket 20. The bracket includes a centrally disposed horizontal component 22. Such horizontal component is adapted to be positioned beneath the joist 24 of a building 26. Appropriate bolts or screws or the like are employed to effect such coupling. Also as part of the bracket are vertically disposed end components 28. Such end components extend downwardly from the ends of the central extent. Such end components are formed with circular apertures 30. Such apertures are adapted to rotatably receive the ends of the core.

Next provided within the system is a drive controller 34. Such drive controller is co-axially mounted on one end component of the bracket and the adjacent end of the cylindrical core. The drive controller functions in a manner similar to spring-driven blinds which allow the pulling off of material coiled thereon against the action of a spring. When the pulled-off article, the hose in the present invention, is withdrawn, it may be stopped and the core will remain in the last position in which it was oriented. A slight pull and relieving of the pressure will allow the spring within the controller to reverse the direction of the core to rewind the hose or other article to the stored position on the core. Other mechanisms for rotating the core may readily be utilized such a hand crank or a motor under the control of an operator.

Located in association with the core and bracket is a box 38. Such box is positioned permanently in an aperture 40 of a vertical wall of a building at which the system is to be utilized. Its location is preferably adjacent to the bracket. The box has an opened interior end 42. It also has an opened exterior end 44. A passage 46 extends through the entire box from the interior to the exterior end. The passage is for the movement of portions of a hose supported on the core to either the wound or unwound orientation. The box is formed with a long interior extent 48 and a short exterior extent 50.

Located within the passage of the box are a plurality of pairs of short rollers 54. Such rollers are rotatable as when contacted by a moving hose. The short rollers are mounted within the interior extent of the box about both horizontal and vertical axes. Similarly, two pair of long rollers 56 are rotatably mounted within the box, preferably within the short exterior extent of the box. These include rollers rotatable about both horizontal and vertical axes. The long rollers are wider spaced from each other than the short rollers. This orientation allows for the receipt between the long rollers of the hose end and a nozzle 58 attached to the hose.

Figure 6:
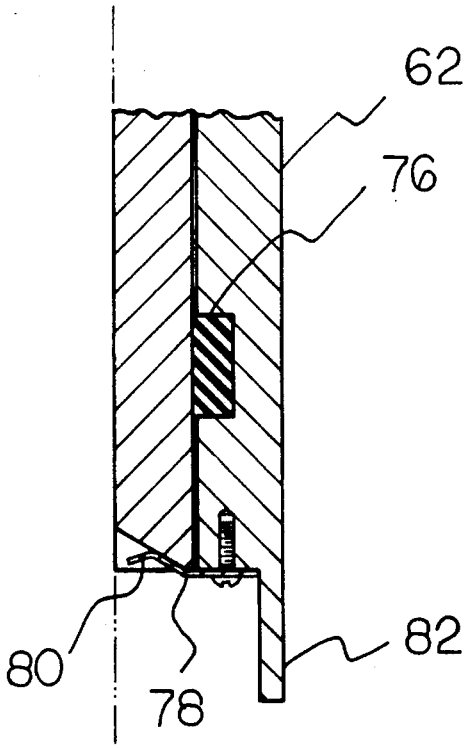
FIG. 6 is an enlarged cross-sectional view of the end of the door shown in FIGS. 1, 3, 4 and 5 illustrating the gasket and sealing components.

In the preferred embodiment of the invention, a door 62 is pivotally mounted through hinges 64 to the box. The door is movable between a raised open orientation as shown in FIGS. 1, 3, 4 and 5 and a lower closed orientation as shown in FIG. 6. The function of the door is to seal the stored hose and passage through the box from the ill effects of inclement weather.

Convenience is provided through a ball 68 urged outwardly by a spring 70 in an aperture 72 formed in the door adjacent to one of the hinges. The ball is urged outwardly toward the hinge and box. In association therewith is a detente 74 of a size to receive a portion of the ball. The detente is formed in the box adjacent to the hinge. The ball and detente in association with the spring function to hold the door in the raised open orientation during use of the hose.

A gasket 76 of an elastomeric material is also provided. Such gasket is located on the interior face of the door at the periphery of the door. The function is to further seal the box when the door is closed. Note FIG. 6. In addition, FIG. 6 also illustrates a locking assembly 78 including a spring tab 80 secured adjacent to the external periphery of the door. The spring is bent inwardly to create a mechanical holding action against the adjacent portion of the box. Downwardly depending from the door adjacent to the locking mechanism is a handle 82 adapted to be grasped by the user during the opening and closing of the door.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hose storage system for supporting a hose in a closed system to facilitate its storage and usage comprising, in combination:

a cylindrical core positionable in a horizontal orientation with opposed ends and a central hose supporting extent therebetween;

a bracket having a centrally disposed horizontal central component positioned beneath the joist of a building and vertically disposed end components extending downwardly therefrom with apertures rotatably receiving the ends of the core;

a drive controller coupled to one end component of the bracket for allowing the rotation of the core in a first direction to effect unwinding of a hose therefrom and for allowing the rotation of the core in a second direction to effect the rewinding of a hose onto the core;

a box positionable in a vertical wall of a building adjacent to the bracket, the box having an open interior end and an open exterior end and a passage therethrough for the passage of portions of a hose supported on the core, the box having a long interior extent and a short exterior extent;

a plurality of pairs of inner rollers rotatably mounted in the interior extent of the box about both horizontal and vertical axes and two pair of outer rollers rotatably mounted in the exterior extent of the box about horizontal and vertical axes, the outer rollers being wider spaced from each other than the inner rollers to allow receipt therebetween of a hose end and a nozzle in the exterior extent of the box;

a door pivotally mounted to the box and movable between a raised open orientation allowing access to a hose and nozzle therein and a closed orientation;

a spring-urged ball in the door located adjacent to the box with an associated detente in the box to hold the door in a raised orientation;

a gasket located within the periphery of the door to effect the sealing closure of the box; and a spring-urged lock formed in the door adapted to be coupled with respect to an adjacent portion of the box when the door is closed.

2. A hose storage system comprising:

a cylindrical core with opposed ends and a central hose supporting extent therebetween;

a bracket having a centrally disposed horizontal central component and vertically disposed end components with apertures rotatably receiving the ends of the core;

a drive controller coupled to one end component of the bracket; and a plurality of pairs of inner rollers rotatably mounted in the interior extent of the box about both horizontal and vertical axes and two pair of outer rollers rotatably mounted in the exterior extent of the box about horizontal and vertical axes, the outer rollers being wider spaced from each other than the inner rollers to allow receipt therebetween of a hose end and a nozzle in the exterior extent of the box.

3. The device as set forth in Claim 2 and further including:

a door pivotally mounted to the box and movable between a raised open orientation allowing access to a hose and nozzle therein and a closed orientation.

* * * * *